United States Patent [19]

Perez

[11] Patent Number: 4,619,172

[45] Date of Patent: Oct. 28, 1986

[54] CUTTING SAW FOR GRINDING SOLID MATERIALS

[76] Inventor: Rafael Perez, Box 474, Saint Just, P.R. 00902

[21] Appl. No.: 751,862

[22] Filed: Jul. 5, 1985

[51] Int. Cl.[4] ..... B27B 33/14

[52] U.S. Cl. ..... 83/830; 83/578; 125/18; 30/166 R

[58] Field of Search ..... 83/830–834, 83/578; 30/166 R, 381; 125/18, 21, 22; 144/34 R, 2 N; 299/35

[56] References Cited

U.S. PATENT DOCUMENTS 4,193,138 3/1980 Johnson ..... 30/166 R
4,258,763 3/1981 Figueredo et al. ..... 125/18 X

FOREIGN PATENT DOCUMENTS 954223 8/1982 U.S.S.R. ..... 83/832

*Primary Examiner*—James M. Meister

[57] ABSTRACT

A cutting element for being longitudinally connected to form a saw which can cut in two or four planes and "to and fro" because of its self-cleaning action during use provided by rotating a blade 90° in relation to its connected preceeding blade.

3 Claims, 9 Drawing Figures

CUTTING SAW FOR GRINDING SOLID MATERIALS

This invention relates to a saw which utilizes a cutting surface that is specifically shaped to cut from right to left and from left to right horizontally without binding, and with removal of sawed substance as the cutting proceeds.

In the normal use of chain saws, the kerf is too wide and results in moving a great deal of substance requiring more power for removal of such a great deal of substance. In addition, there is no attempt at self-cleaning of the kerf in conventional saw blades. This makes the return stroke of a conventional chain saw inefficient.

In a band saw and in a hand saw, there is a constant binding and flexing of the blade either because of its narrow kerf or the relative thinness of the blade.

The saw of this invention provides a cutting element that metigates and eliminates the disadvantages of commonly used chain saws, band saws and hand saws.

Thus a principle object of this invention is to provide a cutting element that is so shaped as to have a self-cleaning effect as it cuts, and to provide horizontal cutting whether the kerf is from right to left or left to right.

Another object of this invention is to provide such a cutting element so that material can be ground away in two parallel horizontal planes.

Another object is to provide for the rotation of the cutting edges of the subsequent teeth of the blade so that one blade is 90° rotated with respect to its connected preceeding blade to provide for self-cleaning of the sawed matter.

Another object of this invention is to provide a cutting blade that is adapted to cut in four planes, 2 parallel horizontal planes and two parallel top and bottom planes.

A further object of this invention is to provide a cutting element that will grind wood, resin, stone, glass and metal by selecting the proper composition for the blade.

A further object of this invention is to provide a cutting element that has a cutting edge that can be easily sharpened.

A final object of this invention is to provide a cutting element that has an edge which can cut material more efficiently and faster than those presently in use.

Although the cutting elements when longitudinally connected can be used to form a hand saw, a band saw and a chain saw, this description will be limited to a chain saw. The cutting element when used for cutting in two laterally spaced planes has an enlarged central portion with cutting edges coverging at the top and bottom to form a simulated isosecles triangle if an imaginary horizontal base line were provided. The recessed edge is so shaped as to render the cutting element to be self-cleaning and to easily cut in a to and fro horizontal direction. To avoid binding, one blade when connected to another is rotated 90° with respect to its preceeding blade.

This invention will be readily understood upon consideration of the accompanying drawing, in which.

Figure 1:
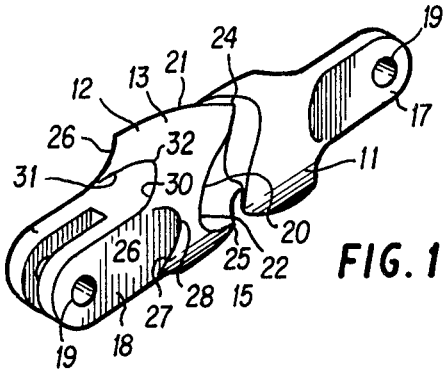
FIG. 1 shows a perspective view of the cutting element of this invention.

In FIG. 1, there is shown a detailed view of the cutting element of this invention, which is adapted to cut in two laterally spaced planes or in all four planes when connected in a series. This cutting element 10 comprises a longitudinally extending element body 11 formed to include an enlarged central portion 12 having top and bottom faces 13 and corresponding side faces and a longitudinal extension at each end of said element formed with a laterally extending pin receiving hole 19 therein, said faces including first oppositely opposed cutting edges 20 and 21 which extend longitudinally from the center 22, and the side faces of said enlarged central portion to substantially meet one another at the center 24 and 25 of the top and bottom faces of said enlarged portion and second oppositely disposed cutting edges 26 and 27 which extend longitudinally from the center 28 and 29 (not shown) of said side faces to one of said longitudinal extensions adjacent said top and bottom faces.

In one form of this invention, the cutting element can also include third oppositely disposed cutting edges 30 and 31 which extend longitudinally from the center 32 and from the top and bottom faces to the side faces of said longitudinal extensions.

Figure 4:
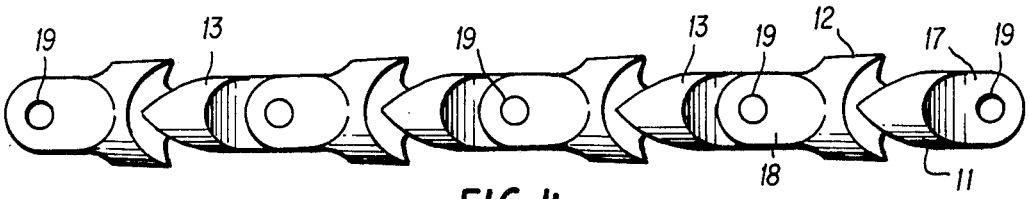
FIG. 4 shows a top view of a series of said cutting elements longitudinally connected for a chain saw that will cut in two laterally spaced planes.
Figure 5:
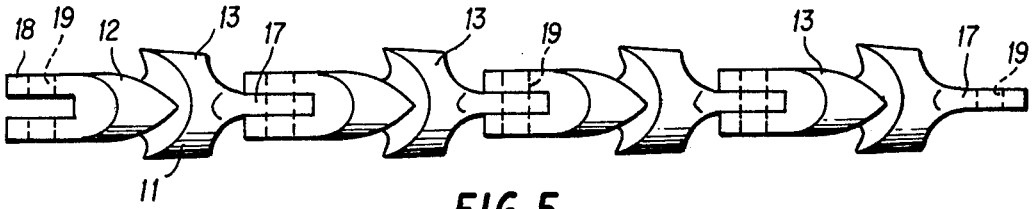
FIG. 5 shows an exploded view of FIG. 4 to show how the elements are connected.
Figure 2:
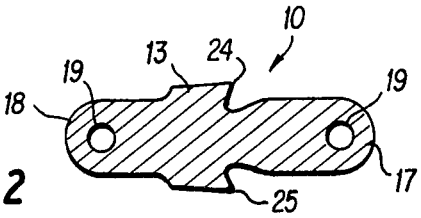
FIG. 2 shows a cross-section view of the back portion of the blade of FIG. 1.
Figure 3:
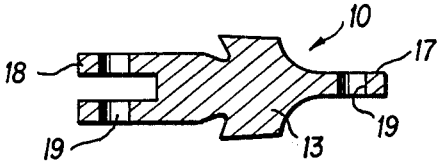
FIG. 3 shows a another cross-section of the front portion of the blade of FIG. 1.

In FIGS. 2 and 3, there are shown cross sections of FIG. 1 to clarify the structure of this cutting element. In FIGS. 4 and 5, there are shown the longitudinal connection to form a chain saw that will cut in two parallel horizontal planes.

Figure 7:
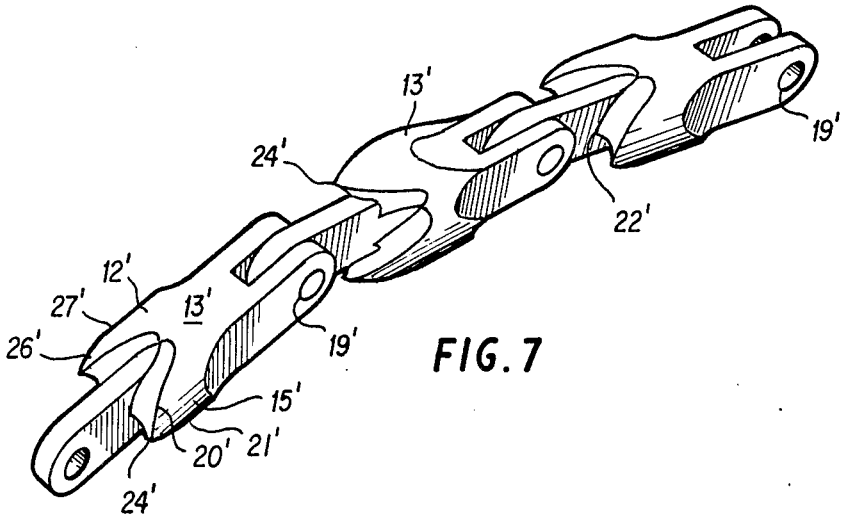
FIG. 7 shows a perspective view of a series of said cutting elements longitudinally connected for a chain saw that will cut in four planes.
Figure 6:
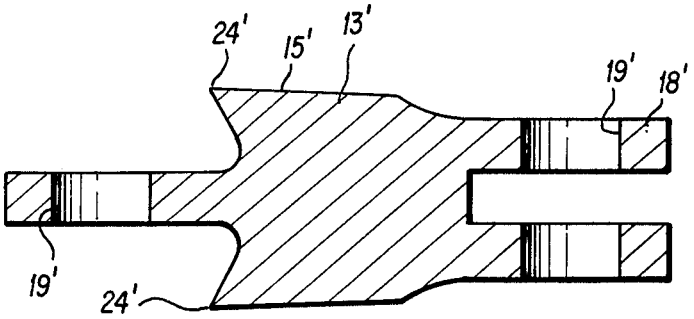
FIG. 6 shows a cross section view of the same cutting element when connected to be used for four planes of cutting.

It is further pointed out that to avoid accumulation of sawed matter as shown clearly in FIG. 7, each blade is followed by another blade which is rotated at 90° thereto.

Figure 8:
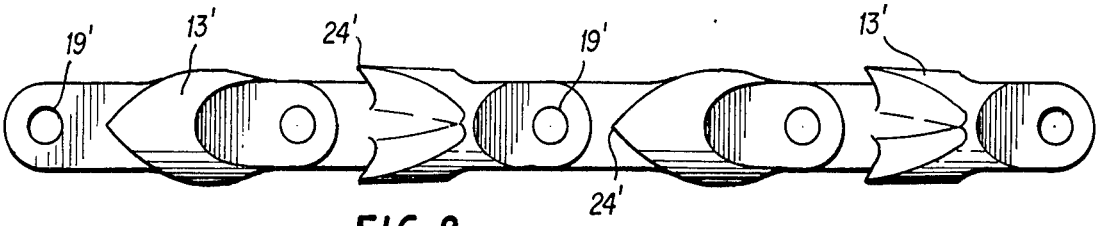
FIG. 8 is a top view of said chain saw.
Figure 9:
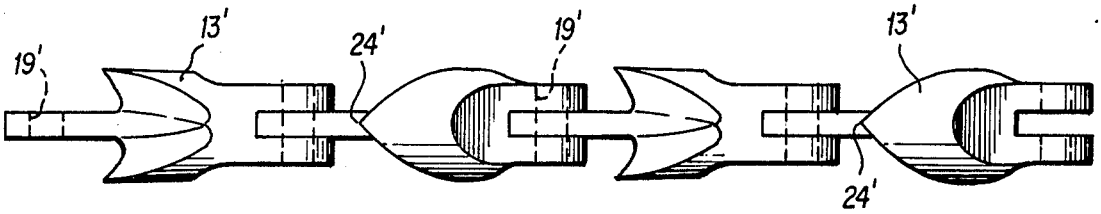
FIG. 9 is a view of FIG. 8 turned on its side to show how the cutting elements are longitudinally connected.

In another form of this invention, the cutting element is arranged to be connected longitudinally as in FIGS. 7, 8 and 9, so as to have similar cutting edges for cutting material in four planes, two parallel longitudinally and two other planes—one on top and the other on the bottom of the cutting element. This chain saw includes two longitudinally extending blades wherein each body of said blade is formed to include an enlarged central portion 12' having corresponding top and bottom faces 13' and 16' (not shown) and a longitudinal extension at each end of said element formed with a laterally extending pin-receiving hole 19' therein, said faces including oppositely disposed cutting edges 20' and 21' which extend longitudinally from the center of the side faces of said enlarged central portion to substantially meet one another at the center 24' of the top and bottom faces of said enlarged portion, and second oppositely disposed cutting edges 15' and 27' which extend longitudinally from the center of said side faces to one of said longitudinal extensions adjacent said top and bottom faces.

Both forms of the chain saw, because of its different connection longitudinally, utilize the same cutting element but one connection will cut in two laterally spaced planes when longitudinally connected and the other form is so connected as to utilize this same cutting element to cut in four planes, not only in laterally spaced horizontal planes but also in two vertical located laterally spaced planes.

It is noted that this cutting element, when connected longitudinally to form a strand of such cutting elements with handles provided at each end, was used by two persons to saw a large circumferenced tree. Because of the cutting element the saw was able to cut "to and fro" in four planes with a self-cleaning action so that this tree was cut down in less than five minutes.

Although this invention is illustrated and described with reference to a single preferred embodiment thereof, it is to be expressly understood that it is in no way limited by the disclosure of such a single preferred embodiment, but is capable of numerous modifications within the scope of the appended claims.

What is claimed is:

1. A cutting element adapted to cut in two laterally spaced planes when connected in series comprising a longitudinally extending element body formed to include an enlarged central portion having corresponding top and bottom faces and corresponding side faces and a longitudinal extension at each end of said element formed with a laterally extending pin-receiving hole therein, said faces including first oppositely disposed cutting edges which extend longitudinally from the center of the side faces of said enlarged central portion to substantially meet one another at the center of the top and bottom faces of said enlarged portion, and second oppositely disposed cutting edges which extend longitudinally from the center of said side faces to one of said longitudinal extensions adjacent said top and bottom faces, wherein each successive blade is connected to another by being rotated 90° relative to its preceeding blade.

2. The cutting element of claim 1, when so connected in an alternate longitudinal series as to be adapted to cut in four planes, two laterally spaced horizontal and two laterally spaced vertical planes.

3. The device of claim 1 which is adapted for sawing to and fro without binding because of its self-cleaning action provided by rotating the blade 90° relative to its preceeding connecting blade.

* * * * *